US006540102B2

(12) United States Patent
Gates et al.

(10) Patent No.: US 6,540,102 B2
(45) Date of Patent: Apr. 1, 2003

(54) APPARATUS AND METHOD FOR ARTICLE DISPENSING

(75) Inventors: Anthony M. Gates, Clive, IA (US); Gary L. Walke, Bondurant, IA (US)

(73) Assignee: Inland Finance Company, Des Moines, IA (US)

( * ) Notice: Subject to any disclaimer, the term of this patent is extended or adjusted under 35 U.S.C. 154(b) by 53 days.

(21) Appl. No.: 09/749,717

(22) Filed: Dec. 27, 2000

(65) Prior Publication Data

US 2001/0030197 A1 Oct. 18, 2001

Related U.S. Application Data

(60) Provisional application No. 60/192,985, filed on Mar. 28, 2000.

(51) Int. Cl.[7] ..... G07F 11/00
(52) U.S. Cl. ..... 221/75; 221/197
(58) Field of Search ..... 221/75, 129, 242, 221/123, 124, 197; 312/215; 211/59.2, 59.3

(56) References Cited

U.S. PATENT DOCUMENTS

| | | | | |
|---|---|---|---|---|
| 3,421,657 A | | 1/1969 | Larson | |
| 3,424,345 A | | 1/1969 | Payne | |
| 4,757,915 A | * | 7/1988 | Albright et al. | 221/75 |
| 5,547,105 A | | 8/1996 | Oden et al. | |
| 5,788,117 A | | 8/1998 | Zimmanack | |

FOREIGN PATENT DOCUMENTS

| | | | |
|---|---|---|---|
| EP | 0 258 668 A1 | | 3/1988 |
| EP | 0572 119 A2 | * | 1/1993 |
| EP | 0 572 119 A2 | | 12/1993 |
| WO | WO 99/53808 | | 10/1999 |

* cited by examiner

*Primary Examiner*—Kenneth W. Noland
(74) *Attorney, Agent, or Firm*—McKee, Voorhees & Sease, P.L.C.

(57) ABSTRACT

An apparatus and method for article dispensing includes an article bay for holding a plurality of articles, and a conveying mechanism below the article bay operable to move an article. The conveying mechanism can repeat such movement for succeeding articles to a dispensing location. Succeeding articles can optionally be placed on top of the articles directly on the conveying mechanism. The succeeding articles are retained until they move by gravity to the conveying mechanism.

56 Claims, 11 Drawing Sheets

APPARATUS AND METHOD FOR ARTICLE DISPENSING

REFERENCE TO RELATED APPLICATION

Reference is made under 35 U.S.C. §119(e) to provisional application U.S. Ser. No. 60/192,985, filed Mar. 28, 2000.

BACKGROUND OF THE INVENTION

A. Field of the Invention

The invention relates to dispensing mechanisms, and in particular, one-by-one dispension of articles, for example, from a vending machine.

B. Problems in the Art

It is usually desirable to maximize the amount of product that can be stored in a vending machine. For a variety of reasons, there are usually practical restrictions on the size of vending machines, and therefore, restrictions on the amount of interior space available for storing an inventory of articles to be dispensed.

For example, beverage dispensers generally have relatively uniform cabinet sizes. The more product that can be stored in the vending machine, the less labor and time is required for restocking the machine. This generally results in more profit per machine. Storage space inside a vending machine is not unlimited. Such things as dispensing mechanisms, coin/bill/token validators, selection mechanisms, and other conventional vending machine components share such space. Other types of components include refrigeration mechanisms, partitions, structural members, and insulation.

Of course, other considerations have importance concerning vending machine dispension apparatus and methods. Some examples are as follows. The machine must be convenient to load and restock. Dispensing must be reliable so that only one article is dispensed at a time. The monitoring of each dispension can be important. The apparatus must be efficient and economical. Preferably the structure should be as non-complex as possible, but as durable as possible.

A common way to dispense some vendible products is to support a row of product horizontally on a tray, track, or other supporting structure, and sequentially move products in the row one by one to a dispensing location. Conveying mechanisms, such as helixes or other structure, are actuated to move the row of products along the tray or track. This type of dispensing assembly is used in the vending machine art frequently for candy and candy bars, bagged vendibles such as potato chips or shaving razors, or other relatively small and light products. It allows a number of products to be loaded into each tray or track. It generally provides dependable one by one dispension because many times it singulates each product immediately upon loading. However, each tray or track must be individually loaded all the way to the back. This can be time consuming and cumbersome. Each row, or sometimes two side by side rows, must have its own supporting structure, motor, side walls and conveying mechanism. This is more costly and uses up valuable space inside the vending machine.

In the case of cylindrical containers, such as beverage cans or bottles, many attempts have been made to meet the above-described types of goals. A common structure of using gravity to feed successive beverage cylinders to a dispensing mechanism involves the use of serpentine tracks or guides. This type of structure maintains a series of cans in a gravity-fed row. A dispensing mechanism can then more easily deal with ensuring one can at a time is dispensed.

Also, such an arrangement prevents bridging or jamming of cans during the gravity feed procedure. While this works in most instances, it uses a relatively substantial amount of materials and structure in the interior of the vending machine. The structure takes up valuable space which otherwise could be used to store additional articles for dissension.

Maximization of the number of articles or products stored in a vending machine and ready for dispension can be achieved by eliminating, as much as possible, structure between articles. Dispensing systems for beverage cans and bottles exist which allow vertical stacking of cans or bottles over one another in vertical columns. A bottom supporting structure supports the vertically stacked columns. Beverage containers are stacked in vertical columns between vertical sidewalls in the vending machine cabinet. A dispensing mechanism at the bottom of each column singulates and dispenses containers one-by-one. This type of arrangement generally maximizes the use of space inside the vending machine because it minimizes the amount of structure needed to support and guide a given number of product to a dispensing location.

However, a problem with both the serpentine configurations and the vertical column arrangements is that the beverage containers must be carefully placed one after another in the serpentine row or vertical stacked columns. If not carefully placed, maximization of room is not achieved, or bridging or disruption of dispensing can be caused because of misalignment. Such careful stacking also takes valuable time for personnel stocking the machine. With regard to vertical columns, reaching to the very back of a column can also be cumbersome and difficult, especially if care in creating uniform precise vertical columns is required.

Such arrangements normally need some structure or mechanism to feed the articles to be dispensed to a dispensing mechanism. This could involve angles or ramped walls. It could involve some mechanical actuator, such as a spring-loaded or electro-mechanical pusher. Furthermore, these arrangements normally require some separate sort of electromechanical structure or system to singulate and move one article at a time to a dispensing location, and prevent any other articles from doing so. This can result in additional structure, complexity and cost. More things could go wrong. It is more difficult to maintain.

Therefore, there remains room in the art for improvement in article storage and dispensing mechanisms in vending machines.

It is therefore a principal object of the invention to provide an apparatus and method for article dispensing which improves over or solves the problems and deficiencies in the art.

Other objects, features, and advantages of the invention include a method and apparatus for article dispensing that:

A. is convenient to load.

B. reliably dispenses product one at a time.

C. maximizes the amount of space within a given environment for articles to be dispensed.

D. is relatively non-complex.

E. is efficient and economical to manufacture, assemble, install, operate, and maintain.

F. is durable.

G. Minimizes number and complexity of parts, and number and complexity of moving parts.

These and other objects, features, and advantages of the present invention will become more apparent with reference to the accompanying specification and claims.

SUMMARY OF THE INVENTION

The invention includes an apparatus and method for article dispensing. The apparatus includes an article dispenser comprising an article bay defining a space for holding a plurality of articles at least along a lower horizontal row, but possibly including another horizontal row stacked on the lowermost row. In some configurations further layers or additional articles can be placed over preceding articles in a generally vertically stacked relationship. A conveying mechanism below the space supports lower-most articles and is operable to move lower-most articles towards a dispensing location. If additional articles are stacked above the lower-most layer, some articles stay above the lower-most layer as the lowermost layer moves to the dispensing location, while some articles dispensed from the lower-most positions are replaced by gravity by articles from the space above the conveying mechanism. Eventually, all articles drop into some position on the conveying mechanism and can be moved to the dispensing location.

Another aspect of the invention is one or more article dispensers, as previously described, in combination with an article-dispensing machine, for example, a vending machine.

A method according to the present invention includes a method of dispensing articles comprising supporting a lower sub-set, for example a layer of articles, of a set of articles which are vertically stacked upon one another, and moving the lower sub-set towards an outlet while containing the other articles above the lower sub-set, and while allowing articles from above the lower sub-set to replenish by gravity dispensed articles from the lower subset.

Optionally, the method could involve a single lower layer, or a lower layer and one succeeding layer over the lower layer.

A further aspect of the method, according to the invention, includes dispensing articles one at a time according to instructions from an article-dispensing controller.

DETAILED DESCRIPTION OF THE PREFERRED EMBODIMENT

A. Overview

Figure 1:
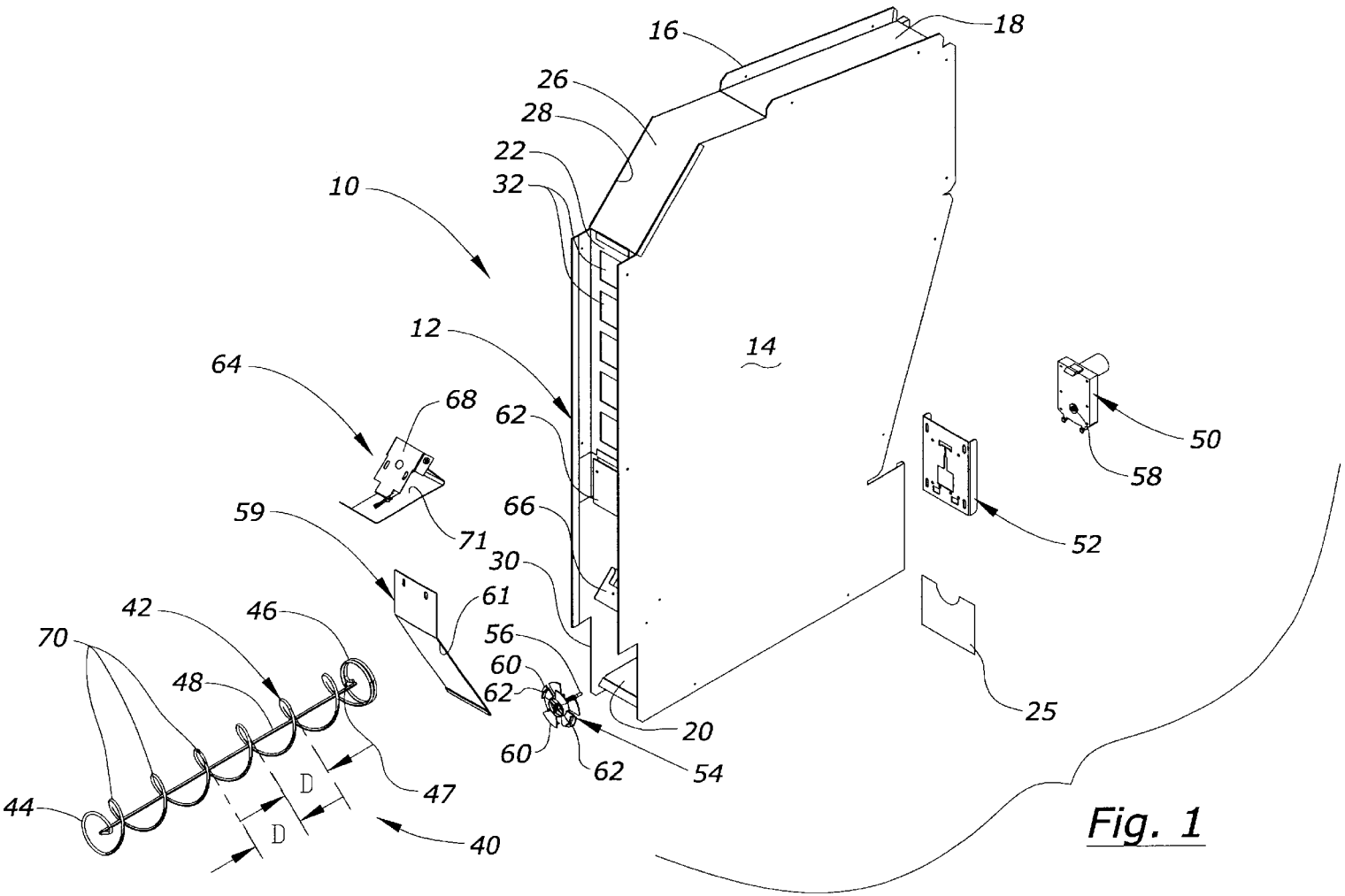
FIG. 1 is an exploded perspective view of one embodiment of an article dispensing assembly according to present invention.

To gain a better understanding of the invention, a preferred embodiment will now be described in detail. Frequent reference will be taken to the drawings. Reference numerals or letters will be used to indicate certain parts or locations in the drawings. The same reference numerals or letters will be used to indicate the same parts and locations throughout the drawings, unless otherwise indicated.

B. Environment

The preferred embodiment now described will be with respect to a dispenser used for dispensing 1.75-ounce cylindrical packaged crisps vendible containers (approximately 3 inches diameter, 3.437 inches long), such as are known in the art, in a conventional vending machine. The scale of the embodiment, therefore, is to be understood with respect to this type of article. It is to be understood, however, that the invention is applicable to other articles and its scale can vary accordingly.

C. Structure

FIG. 1 shows dispenser assembly 10 in exploded form. Main framework 12 includes parallel sidewalls 14 and 16, top 18, bottom 20, and front-end wall 22. A back-end wall 24, similar to wall 22, and following the profile of the back-ends of sidewalls 14 and 16, is also attached to framework 12, but not shown.

Framework 12 defines an internal article bay or space 26 into which articles to be dispensed can be placed in bulk. An opening 28 at the top and front of framework 12 allows sufficient access and entry to interior space 26. An outlet opening 30 at the bottom front of framework 12 provides a dispensing opening from space 26. Several small openings 32 in front-end wall 22 allow a worker to view into space 26, to check how many articles are contained therein, without allowing any of the articles to move out of space 26 through such openings 32.

The components described previously can be made of sheet metal (for example, galvanized steel, 0.048 inch thick). Other materials are possible.

The width of space 26 is designed to be the same or closely equivalent to the longest dimension of the articles to be dispensed. In the case of 1.75 oz. packaged crisps containers, the distance between sidewalls 14 and 16 is 3.593 inches. The height of space 26 is approximately 35.250 inches, while front to back it is approximately 25.5 inches. Space 26 would thus hold on the order of seventy-five 1.75 oz., packaged crisps containers of the type described above when full. The entire dispenser assembly is sized to fit within a conventional sized beverage vending machine.

FIG. 1 shows a product auger 40 comprised of a helical wire 42 having opposite front-end 44 and back-end 46 and a center wire 48 extending along generally the longitudinal axis of helical wire 42 supported in, or adapted to be supported or positioned in opposite ends 44 and 46 of helical wire 42. A piece, not shown, can connect end 47 of center wire 48 to coupling 54.

An electric motor 50 is mounted to framework 12 by motor bracket 52 (by machine screws, bolts, or other mounting hardware). Motor 50 can snap into bracket 52. Auger coupling 54 includes a splined axle 56 that is insertable into a mating rotary drive 58 of motor 50 and rotates with rotation of rotary drive 58. Circular end 46 of helical wire 42 is connectable (e.g. snaps) into segments 60 of auger coupling 54, which captures end 46 in a manner that prevents separation or rotation between coupling 54 and auger 40. Snap-in receivers on coupling 54 center the longitudinal axis of auger 40 and also serve to clamp or otherwise hold end 46 so that there is direct one-to-one rotation of auger 40 with respect to auger coupling 54. A back piece in the general shape of a plate 25 (see FIG. 1) could be installed between side walls 14 and 16 in the lower back of framework 12. Coupling 54 could seat down into the curved top of piece 25, which would act generally as a bearing and retainer of coupling 54 when rotating, keeping it against longitudinal movement. Other methods of connection are possible.

Product deflector 59 is removably mountable into a complementary bracket 62 between sidewalls 14 and 16. The lower angled portion of deflector 59 (reference numeral 61) extends obliquely downward and inward (see FIG. 2) from its connection 62. Member 64 is rearwardly mountable (see FIG. 2) onto bracket 66 which is mounted between sidewalls 14 and 16. Member 64 can have mounted to it an electromechanical switch 68 that will be described in more detail later.

D. Operation

Figure 2:
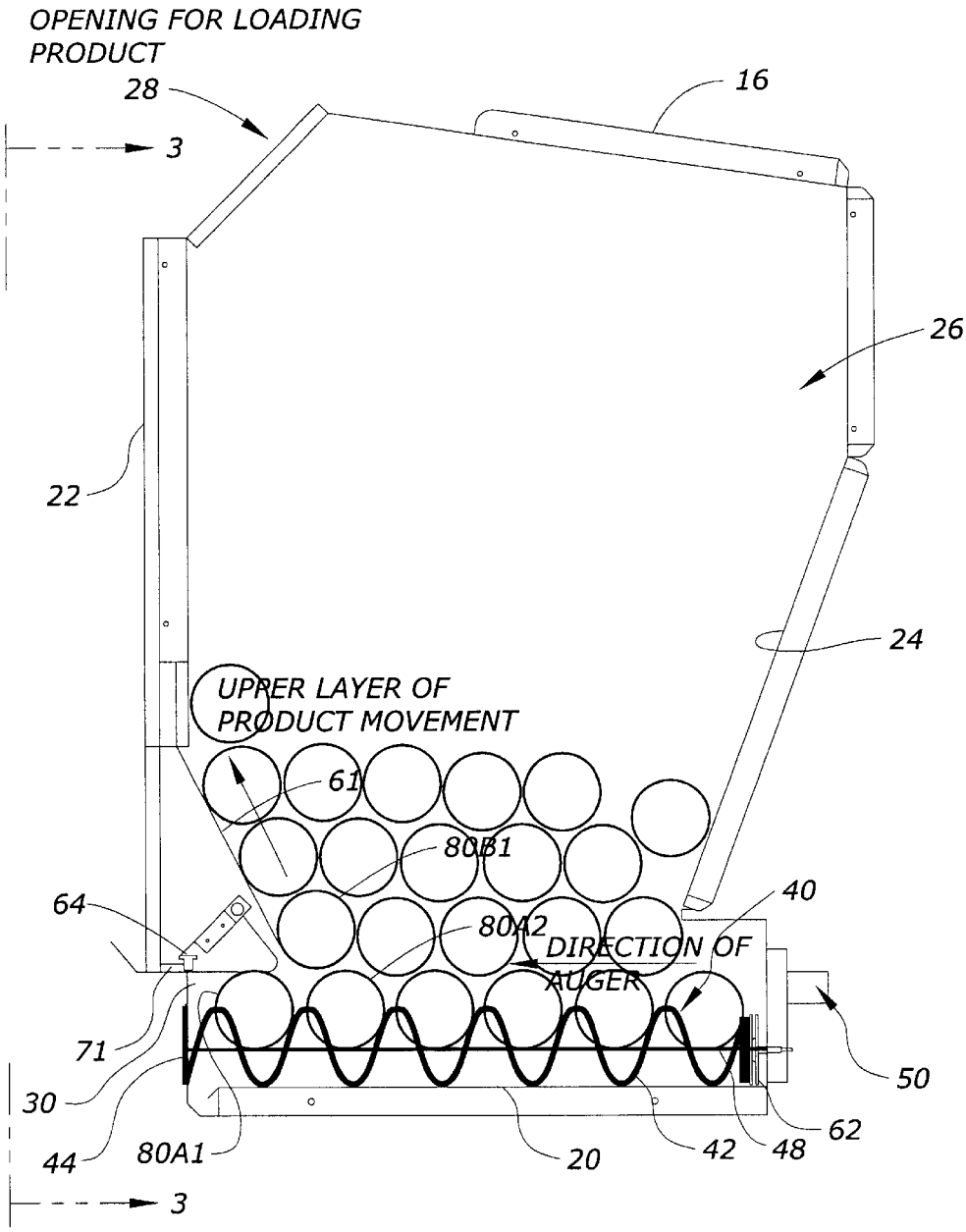
FIG. 2 is a side elevation view of the embodiment of FIG. 1 assembled, but with sidewall 14 removed to show the interior of the embodiment.
Figure 3:
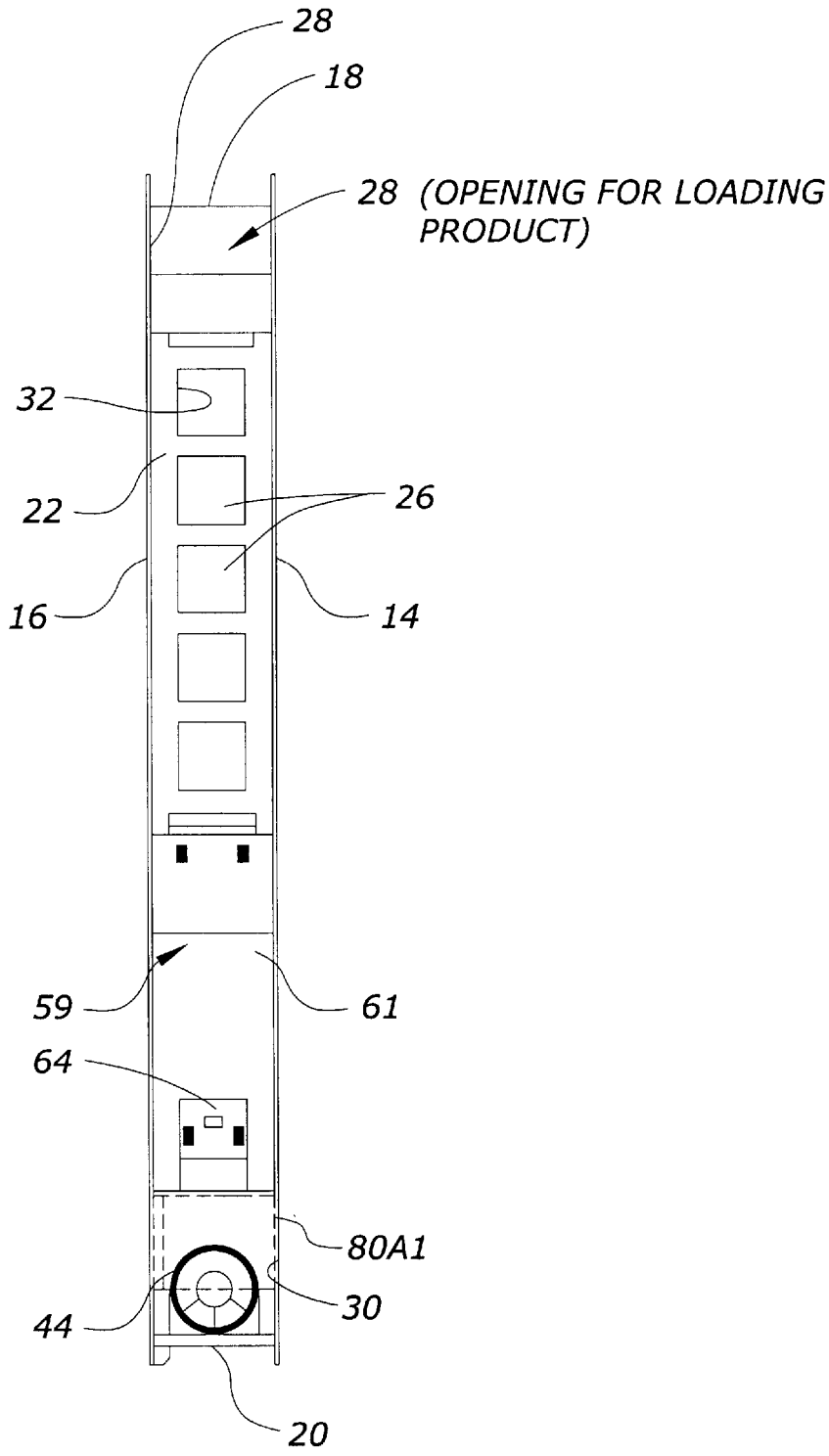
FIG. 3 is an end elevation view taken along line 3—3 of FIG. 2.

By referring to FIGS. 2 and 3, operation of the invention is illustrated. Spacing between flights 70 of auger wire 42 (see distance D in FIG. 1) is sized to receive at least a part of the width of a container 80.

As indicated in FIG. 2, a plurality of containers 80 can be loaded through opening 26 in framework 12 to fill space 26 if desired. Containers 80 do not have to be stacked in perfectly aligned vertical columns. Preferably, however, containers 80 are dropped or placed with their longitudinal axis generally perpendicular to side walls 14 and 16.

Once space 26 is filled to the level desired, a bottom-most layer of containers 80 will be in contact with and supported by center wire 48 between flights 70 of auger 40. The remainder of containers 80 above that bottom layer, will be supported by auger 40 and the bottom layer and succeeding containers up to the top-most layer of containers 80 in space 26. Therefore, loading of space 26 is quick and easy and does not require a lot of attention.

Dispenser assembly 10 is installable into a vending machine by means well within the skill of those skilled in the art. Assembly 10 can be bolted, screwed, or otherwise mounted inside a vending machine. Outlet opening 30 would be positioned adjacent to a delivery chute (not shown) in a vending machine that would channel a dispensed container 80 to an access opening or position for a customer to access and remove. Motor 50 (24 VDC) would be connected to a vending machine controller (not shown) that would send an electrical signal after the appropriate money or token is acknowledged from a customer. Motor 50 is a conventional snack vender type motor and is configured to turn rotary drive 58 360° or one revolution upon receiving an appropriate signal from a controller. Such a motor and controller are well known and available from a number of commercial sources.

As can be seen in FIG. 2, containers 80 fit transversely between flights 70 of helical wire 42. Therefore, one complete revolution of helical wire 42 would move a flight 70 a distance D, which is approximately the width of one container 80. Thus, a vending machine controller, not shown, would operate motor 50 to complete one revolution of helical wire 42 at a time to move the left-most container 80 from a retained position between the left-most flight 70 of helical wire 42, to a position to the left of the left-most flight 70 of helical wire 42, and through outlet 30.

As shown in FIG. 2, container 80-A1, positioned along the lower layer of containers 80 in space 26 would then be dispensed. Container 80-A2, also originally in the lower layer of containers in space 26 (but one position to the right of container 80-A1), would then move to the left-most position relative to auger 40 (formerly occupied by container 80-A1) and thus be ready for dispension upon the next complete revolution of helical wire 42.

It is to be understood that when originally filled, space 26 would not necessarily have containers 80 arranged in precisely uniform vertical columns and horizontal rows. Some containers 80 could end up in somewhat staggered vertical columns and/or somewhat uneven horizontal rows. As space 26 is filled, the weight of succeeding containers 80 would cause containers 80 to compact to the extent possible based on their orientations.

Rotations of helical wire 42, combined with the downward gravitational pressure of containers 80, would tend to cause the lower level of containers 80 to find a transverse position between flights 70 of helical wire 42.

The bottom surface of switch bracket 64 is spaced approximately the width D of a container 80 above center wire 48 of product auger 40. Center wire 48 not only supports the product (here containers 80-A1, 80-A2, etc.) in the lower level of containers, but also maintains the length and shape of helical wire 42 of auger 40. Helical wire 42 and center wire 48 can be made from the same piece of 0.156 inch diameter cold drawn wire.

Portion 71 of bracket 64 and product deflector 60 cooperate to disallow any container 80 above lower level to move to outlet 30. Deflector 64 makes sure that only one container 80 is dispensed at a time. Container 80-B1, and other containers adjacent deflector 64, but not in the lower-most row, would move up deflector 64 and back into the remaining containers 80 upon movement of the lower row or layer of containers 80-A1, 80-A2, etc. towards outlet 30, or products 80 above the lower row or layer of products would ride over (some might even rotate) the lower most layer when it advances towards outlet 30.

As containers 80 are dispensed from outlet 30, spaces between flight 70 and helical wire 42 will be created and filled by gravity by product previously above the lower level of containers 80, to replenish those now unoccupied spaces.

Dispenser assembly 10, therefore, accommodates a large number of cylindrical products and dispenses them one at a time. An electromechanical switch mechanically senses the passage of a container 80 thereby and sends a signal to a vending machine controller (not shown) to verify that the product is in the dispense position. It also can tell a controller when assembly 10 is sold out of product, if no product is sensed in position 80A1. It can also count each product dispensed. Other types of sensors could also be used.

As previously mentioned, dispenser assembly 10 is loaded through the top-front opening 28. The product is dropped or placed into the main storage area or space 26. When space 26 is first loaded, the operator could rotate product auger 40 until the operator is assured that a product is in the position shown at 80-A1 in FIG. 2 to assure the first customer selecting a product from assembly 10 will receive a product.

During operation, product in dispenser assembly 10 will move over itself during the dispensing process. The movement caused will make sure that any bridging of product is cleared. The entire product will eventually reach the outlet of dispenser 10.

Dispenser assembly 10 holds the maximum amount of product possible since there are no non-product objects or structure between each article. Delivery chute 30, at the location of article 80-A1 in FIG. 2, does not allow article 80-A1 to turn during dispension. The structures around outlet opening 70 could be dimensioned and configured to allow passage of articles therethrough, but hold the foremost article from rotation. For example, member 64 could be sized and positioned to abut the top of the foremost article 80A1 and deter rotation of article 80A1 as it is dispensed.

FIGS. 4–10 illustrate another embodiment according to the invention. This alternative embodiment, referred to generally by reference number 110, operates similarly to the embodiment of FIGS. 1–3. It utilizes a housing which includes sidewalls 116 and 114, bottom wall 120, and back wall 124 defining a product bay, space or retainer. U-brackets 125 and 160 are mounted to the top of the front and back of this housing to add support. Additionally, front u-bracket 160 serves as a stop or retainer for a top layer of product (see FIG. 4). Alternatively, back wall 124 could be left off and member 125 could be a U-bracket like member 160 to hold the top upper sides of the backs of sidewalls 114 and 116. Motor 150 could be mounted on structure surrounding the back end of device of 110, and device 110 could be secured to a vending machine tray or other support. Other structural configurations that accomplish the functions of device 110 could also be utilized.

Like the embodiment of FIGS. 1–3, the conveying mechanism includes a helical product auger 140 positioned along the bottom 120 of the housing between back wall 124 and a front outlet opening 130. A coupler 154 (see FIG. 5), like coupler 54 previously described includes an axle that extends through back wall 124 into a rotary drive of an electric motor 150 mountable on the outside of back wall 124.

A first layer of product 180 is loaded onto helix 140 by placing it substantially between flights of the helix. The products 180 (see 180A1–180A7 in FIG. 4) are thus singulated. Operation of motor 150 moves this lowermost layer of products 180 to outlet opening 130. By appropriate configuration and coordination of the size of helix 140 (including outside diameter, pitch of the flights, and distance between flights), with rotation of the helix by motor 150, foremost product 180A1 can be moved to opening 130 and dispensed out of opening 130. Motor 150 can be stopped and helix 140 will retain the succeeding product 180A2, now in the front or foremost position, until motor 150 is operated again.

Figure 4:
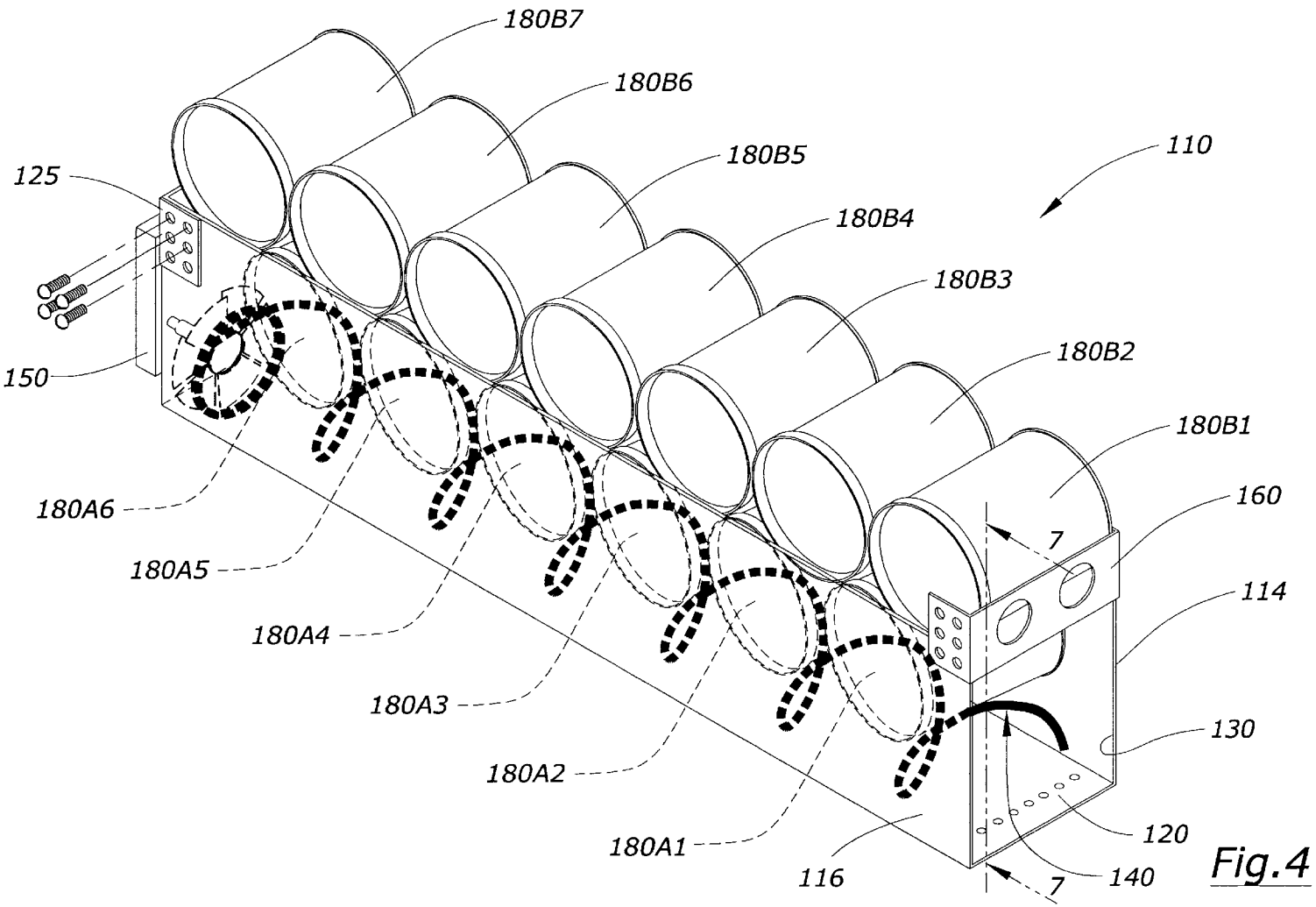
FIG. 4 is a perspective view of another embodiment according to the present invention.
Figure 5:
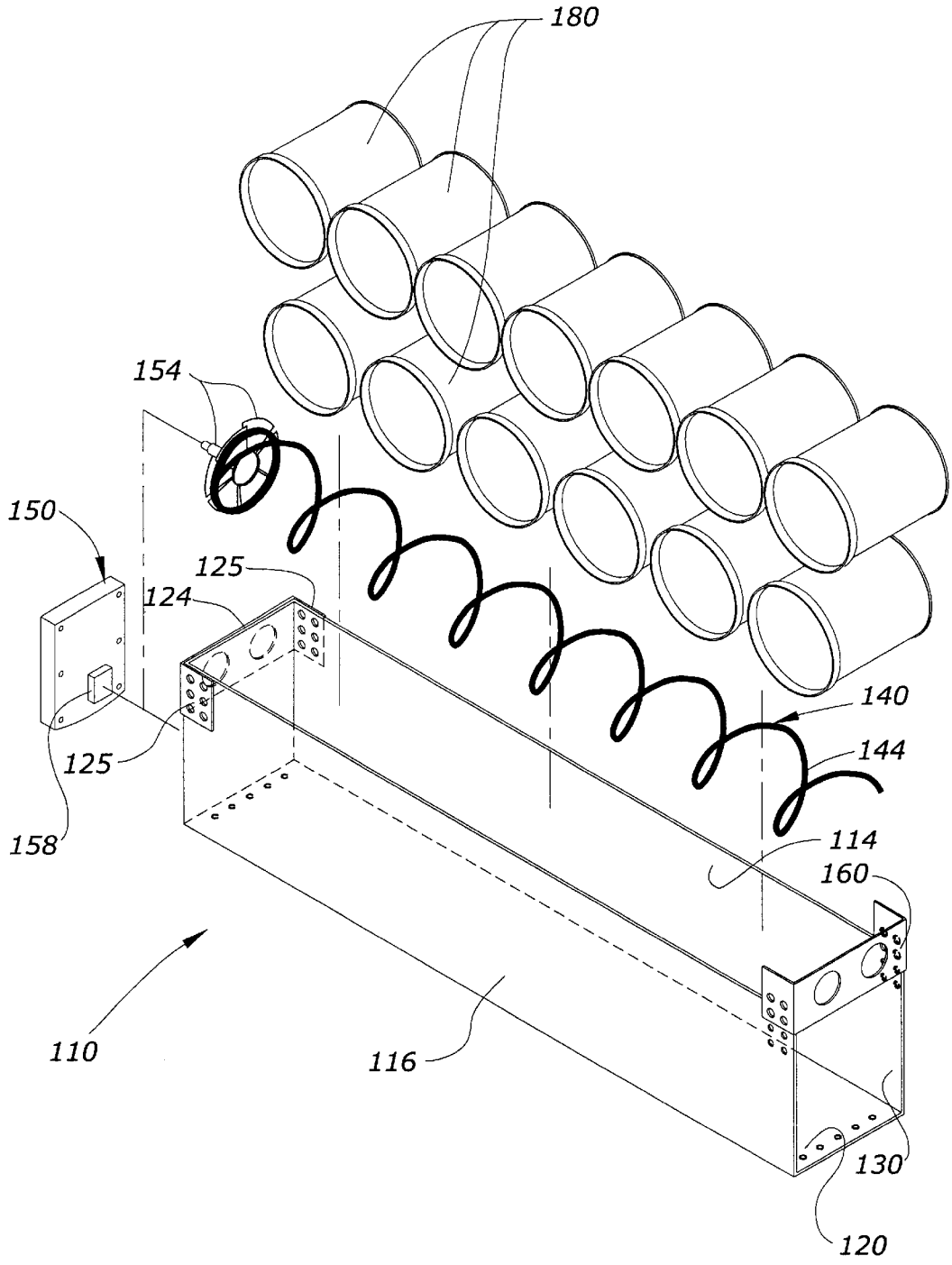
FIG. 5 is an exploded perspective view of FIG. 4.
Figure 6:
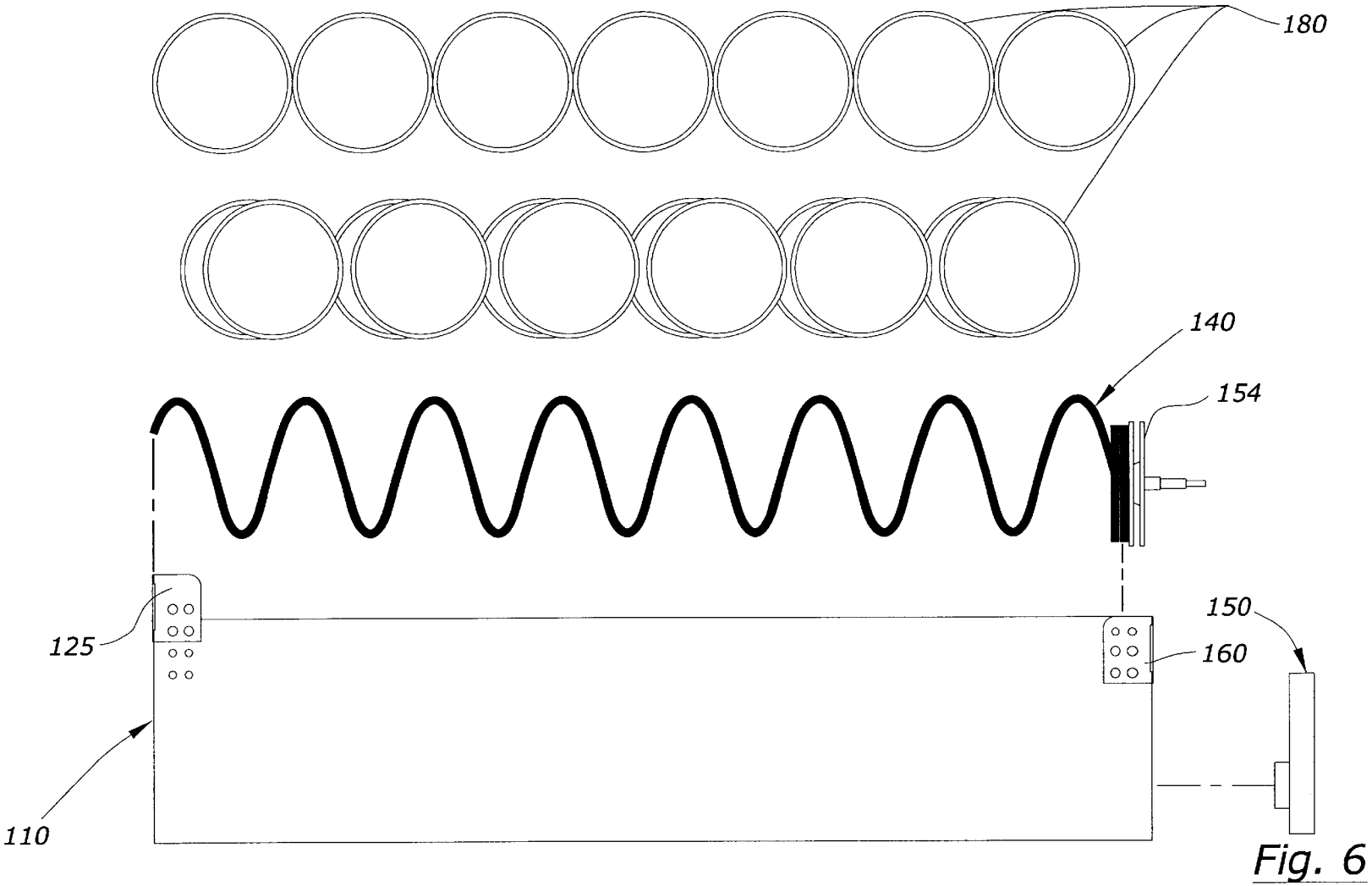
FIG. 6 is a side elevation exploded view of FIG. 4.
Figure 7:
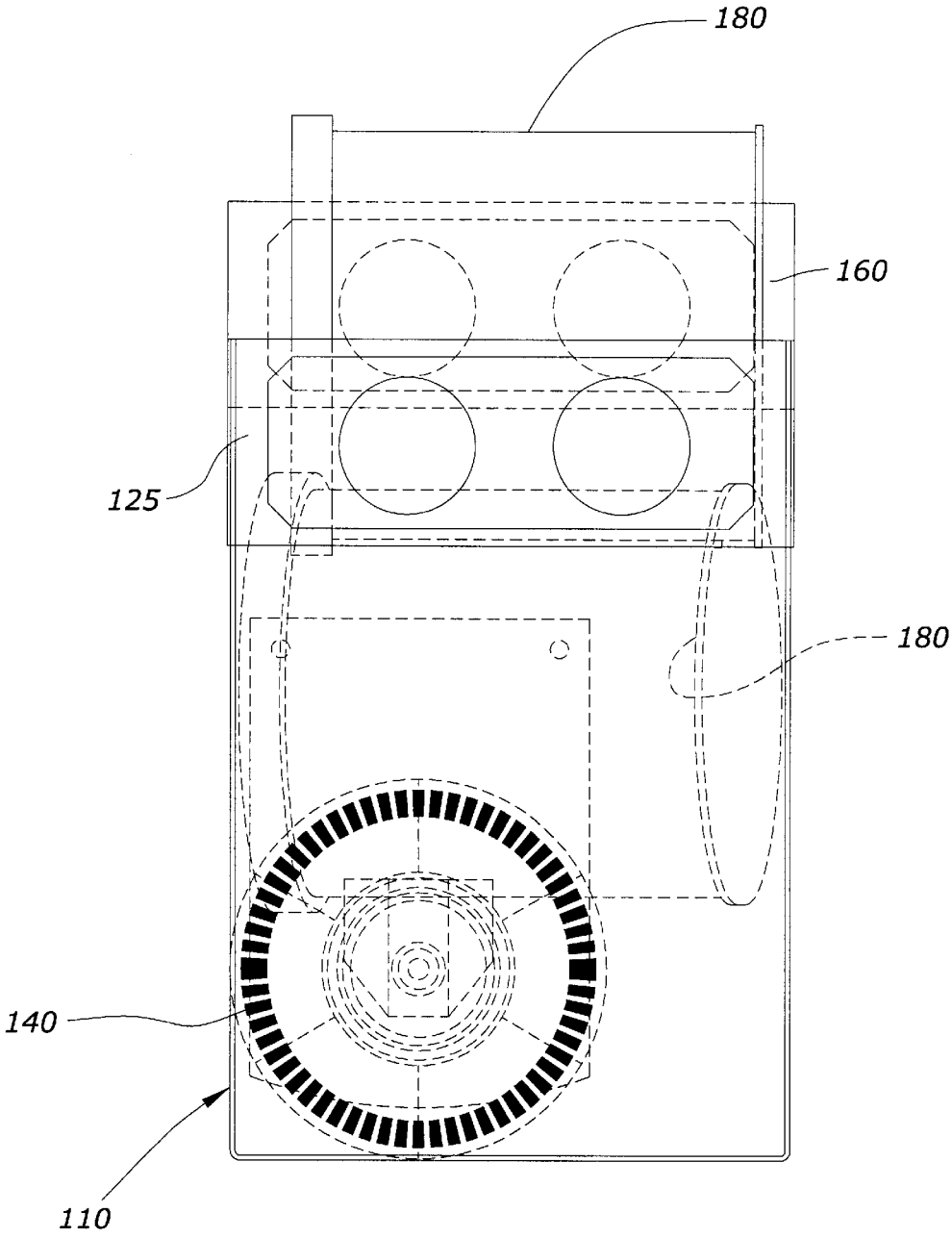
FIG. 7 is a front end elevation view taken from the direction of line 7—7 in FIG. 4.
Figure 8:
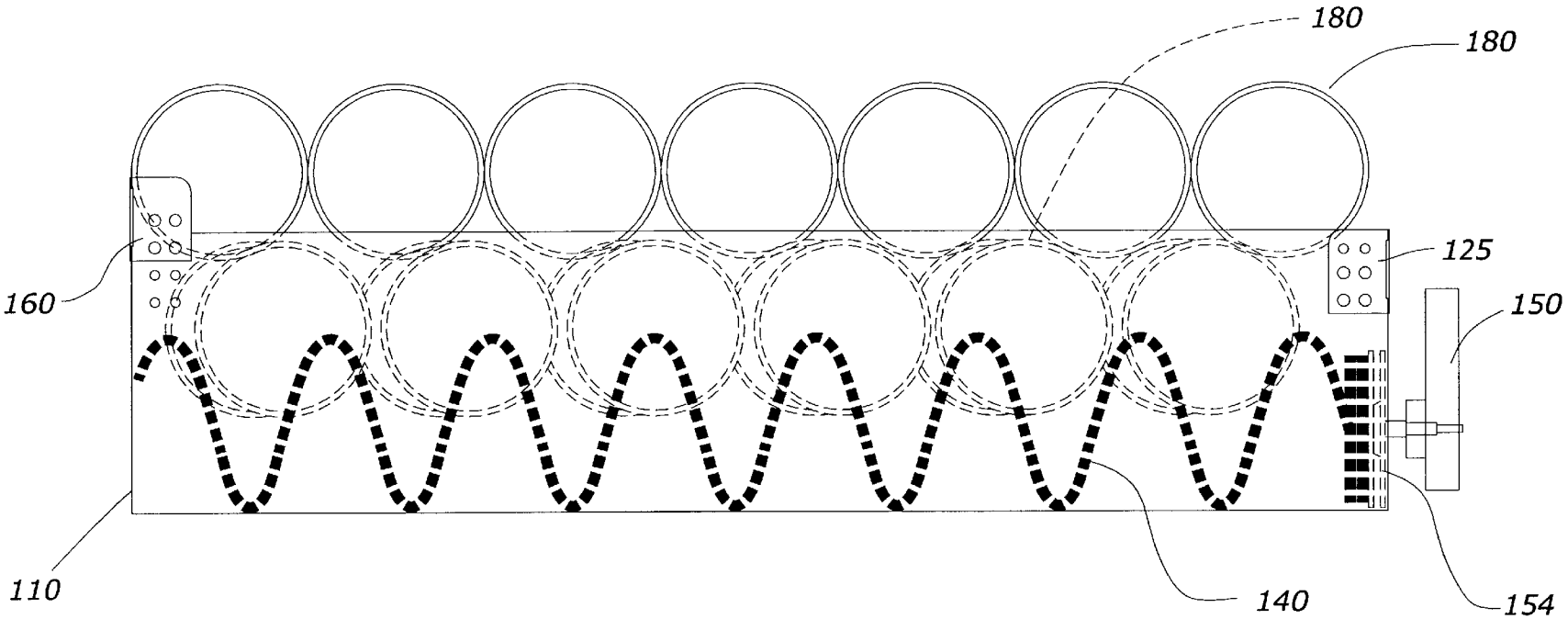
FIG. 8 is a side elevation view similar to FIG. 6 but showing the embodiment in assembled form with products to be dispensed in place.
Figure 9:
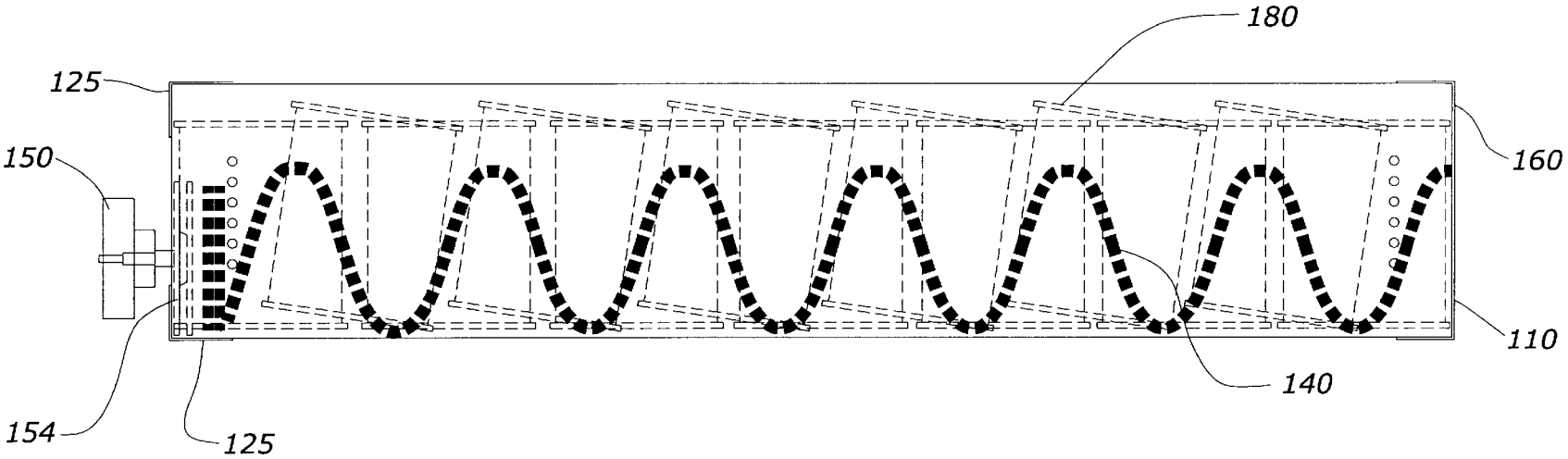
FIG. 9 is a top plan view of FIG. 8.

As shown in FIG. 4, device 110 can be adapted to hold not only a lower row or layer of product 180, but a second layer can be placed right on top of the lower layer. As products 180 in the lower layer are dispensed, the upper layer rides on top of the lower layer. In the instance shown in FIG. 4, products 180 in the upper layer would tend to rotate as the lower layer products 180 move underneath them.

As can be appreciated, products 180 from the upper layer would generally fall by gravity into any position on auger 140 that is vacated immediately under a product in the upper layer. Thus, some of the upper layer products would replenish vacated positions along auger 140 in the lower layer caused by movement of the lower layer towards opening 130 and dispension of product from the lower layer. Other products 180 in the upper layer would ride on top of the lower layer and remain in the upper layer until a position in the lower layer immediately below it is vacated. Thus, during dispension of products from device 110, the lower and upper layers will tend to be similar in number of products until the last several remain, at which time the lower layer will be exhausted of product and the remaining product in the upper layer will fall into auger 44 and subsequently be dispensed. Products 180 in FIGS. 4–9 are 1.75-ounce cylindrical packaged crisps vendible containers (e.g. potato chips) with a paper cylindrical body and a plastic snap-on lid, such as previously described. U-bracket 160 at the front and top of device 110 extends upwardly to block the upper row 180B1–7 of products 180 from moving forward while the lower row moves.

As can be seen more clearly in FIGS. 6–9, the nature of helix auger 140 is such that products 180A1–7 in the lowermost layer, each at least partially between an adjacent pair of flights of auger 140, as angled slightly from the longitudinal axis of auger 140, and not precisely perpendicular to it. Note also that in this embodiment, auger 140 and motor 50 are not precisely in the middle of side walls 116 and 114, but closer to side wall 116. This is not required however. The dimensions of the housing and the auger can vary according to need and desire. Those skilled in the art can design such dimensions for a given product 180.

E. Options and Alternatives

The included preferred embodiment is given by way of example only, and not by way of limitation to the invention which is solely described by the claims herein. Variations obvious to one skilled in the art will be included within the invention defined by the claims.

For example, the preferred embodiment has been described relative a 1.75 ounce crisps packages. It is possible to adapt the invention to work with other items of different size and even shape. Adaptations may be needed. For example, if used for 12 ounce soft drink cans, auger 40 would be strengthened and most likely, the amount of cans stacked, if any, above the lower layer of cans reduced.

Figure 10:
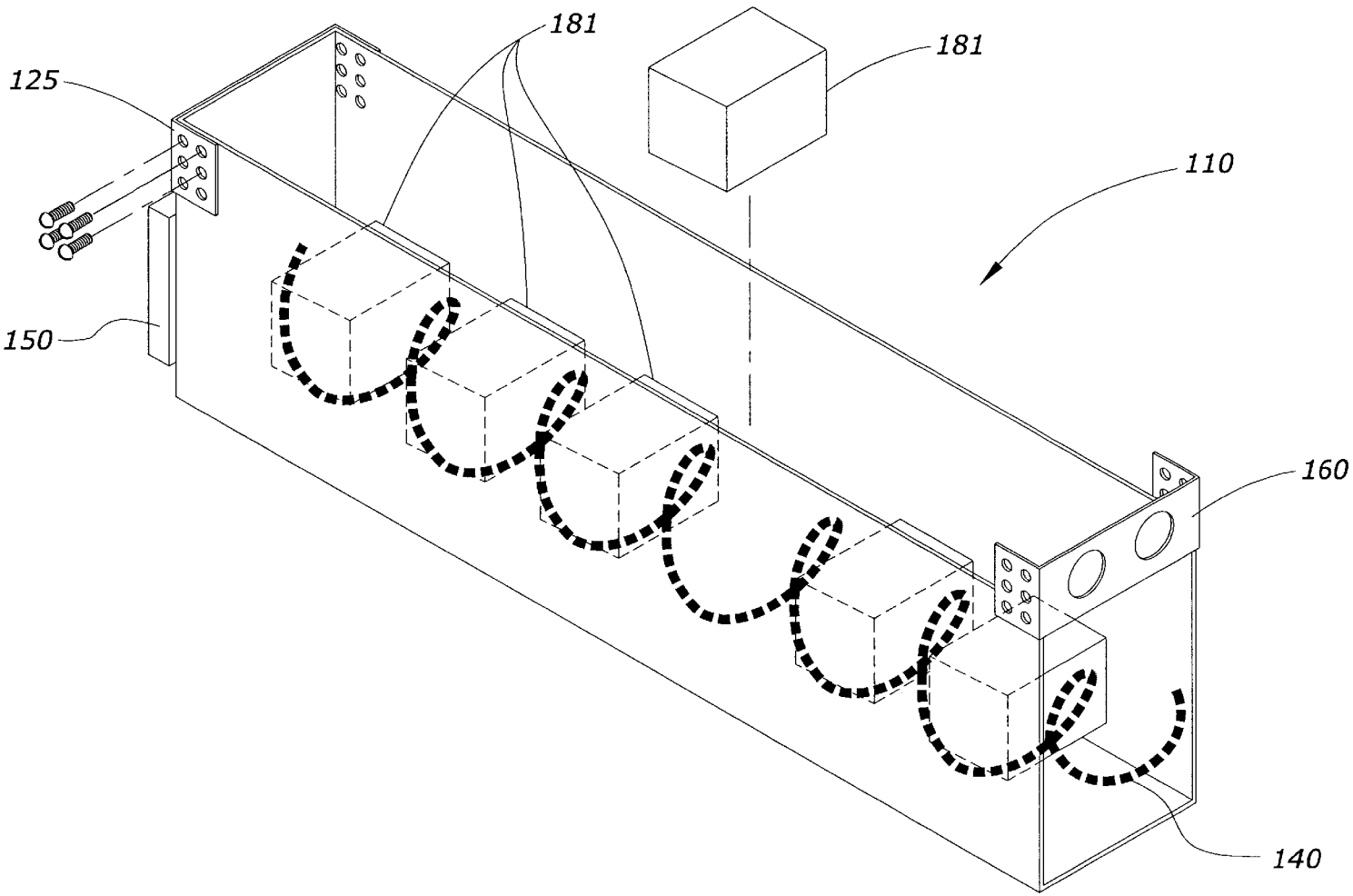
FIG. 10 is similar to FIG. 4 but shows a different type of vendible product loaded in place for dispension.

FIG. 10 illustrates housing 110, as described above, with auger 140 loaded with a row of square-in-cross vendible products 181. This is an example of a different shaped product that could be dispensed. There are many other examples of products that could be dispensed using the present invention.

Figure 11:
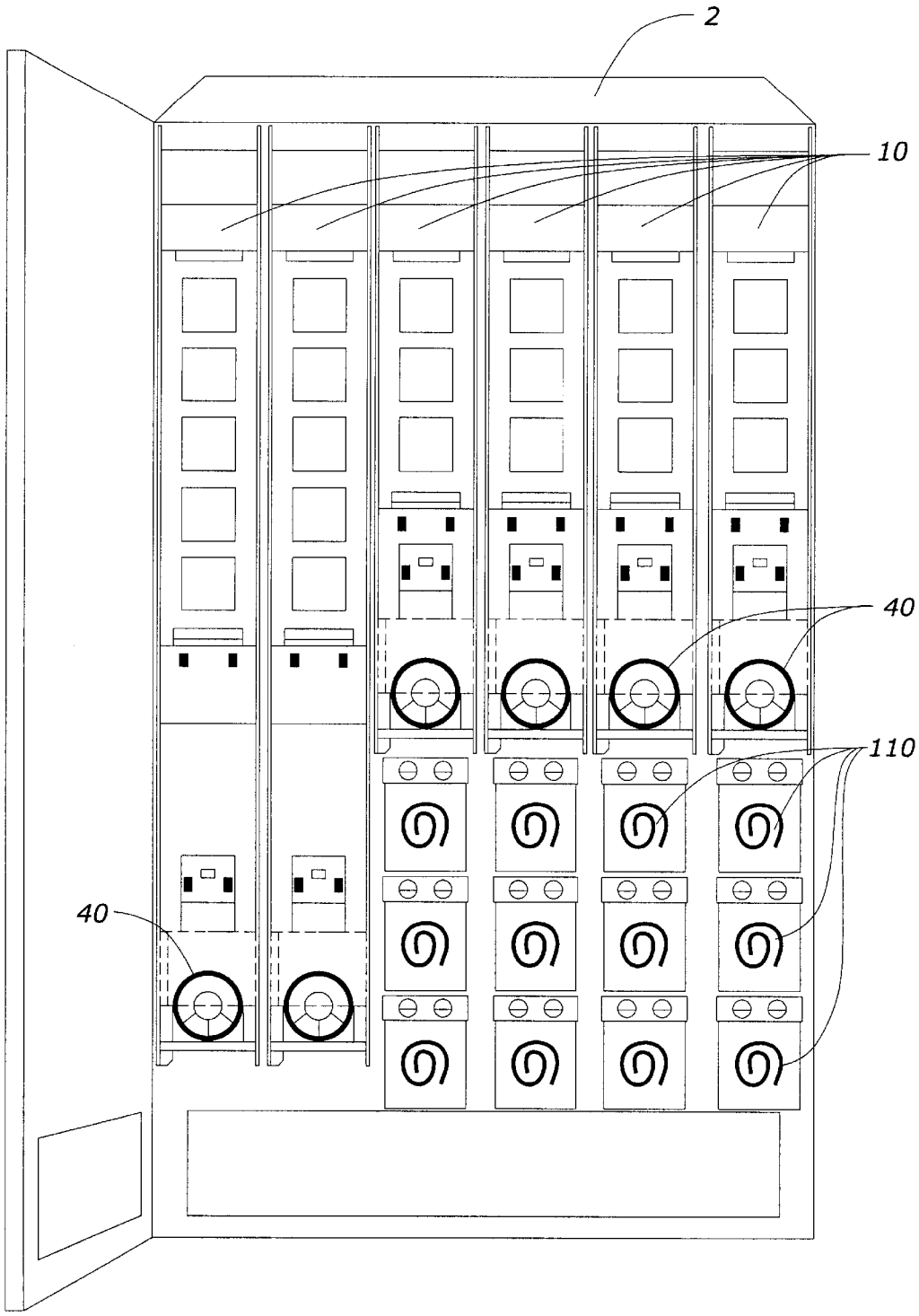
FIG. 11 is a diagrammatic front view illustrating optional placement of the embodiments of FIGS. 1 and 4 into a vending machine.

FIG. 11 illustrates diagrammatically placement of devices 10 and/or 110 into a conventional vending machine 2. As is indicated, one or more devices 10 positioned in vending machine 2 provide good usage of the interior space of vending machine 2. A substantial amount of each device 10 is available for storage of products to be dispensed. Device 10 is easy and quick to load. Device 10 singulates the bottom row of products in preparation for dispension.

Likewise, one or more devices 110 can be placed in vending machine 2. Because they are smaller in vertical dimension than devices 10, they can be placed in a variety of positions, and can be placed side by side, or vertically, or both. They are also easy and quick to load, provide a good utilization of space, and singulate the entire lowermost row ready to dispense.

Thus, it can be seen that devices 10 and 110 represent product dispensers which achieve at least the objects of the present invention. The dispensing mechanism singulates the products reliably by the physical separation of the flights of the helical auger. This allows for reliable one-by-one dispension without complicated structure. The auger combines dispension and singulation. The only electrical device needed is a conventional electrical motor. The dispensing mechanism does not take up a lot of space. It can also be made as strong as needed for reliable and durable operation.

It also is highly flexible. A single auger can usually handle at least some range of product sizes and/or shapes and/or weight. But, if a different auger is needed, it is easy to change and does not cost very much. Therefore, maintaining an inventory of different augers, or obtaining different augers is not economically unfeasible. Maintenance is also efficient, economical and easy, as there are few moving parts, the parts are generally relatively inexpensive, and they are easy to fix or replace.

In addition to the other features, both devices 10 and 110 allow, if desired, loading of at least a second row of product above the lowermost row in the auger. The product generally easily finds its position, both in the auger and in any rows or stacking above the auger. The arrangement maximizes the use of space as the product is stacked directly on top of preceding product. There is no intermediary structure needed, which would take space away from the amount of product that can be stored in a given volume of space, ready for dispension.

What is claimed is:

1. An article dispenser comprising:

(a) an article bay having opposite sides retainers defining a space for holding a plurality of articles;

(b) a conveying mechanism in the space of the article bay, and having a longitudinal axis, a first end positioned generally at a dispensing location, and operable to move articles along said longitudinal axis to the dispensing location wherein said space is adapted to hold a first layer of articles along said conveying mechanism.

2. The article dispenser of claim 1 further in combination with a dispensing machine.

3. The article dispenser and dispensing machine of claim 2 wherein the dispensing machine is a vending machine.

4. The article dispenser and dispensing machine of claim 2 further comprising a plurality of article dispensers according to claim 1 installed in the dispensing machine.

5. The article dispenser of claim 1 wherein the bay is adapted to allow a succeeding layer to be placed over the first layer of articles.

6. The article dispenser of claim 5 wherein the bay is adapted to retain succeeding layers of articles.

7. The article dispenser of claim 5 further comprising a plurality of succeeding layers.

8. The article dispenser of claim 1 further comprising opposite side retainers relative said bay.

9. The article dispenser and dispensing machine of claim 2 wherein the article bay and dispensing mechanism are mounted in a unitary housing.

10. The article dispenser of claim 8 wherein the side retainers are spaced a distance relative to the longest dimension of the articles to be dispensed.

11. The article dispenser of claim 8 further comprising end retainers at opposite ends and between said side retainers.

12. The article dispenser of claim 8 further comprising a loading opening at or near the top of said side retainers.

13. The article dispenser of claim 12 further comprising a top cover member between said side retainers.

14. The article dispenser of claim 12 further comprising a bottom member between said side retainers.

15. The article dispenser of claim 1 wherein said conveying mechanism is motorized.

16. The article dispenser of claim 1 wherein said conveying mechanism is adapted to connect to a motor.

17. The article dispenser of claim 16 wherein said motor is an electrical motor.

18. The article dispenser of claim 17 wherein said electrical motor includes an input adapted for connection to a controller.

19. The article dispenser of claim 1 wherein said conveying mechanism comprises an auger.

20. The article dispenser of claim 1 wherein said conveying mechanism comprises flights sized to receive an article to be dispensed therebetween.

21. The article dispenser of claim 20 wherein said auger is rotated about a longitudinal axis.

22. The article dispenser of claim 1 further comprising a motor connected to a second end of the conveying mechanism.

23. The article dispenser of claim 19 further comprising a bottom support floor upon which the auger rotatably rests and is supported by.

24. The article dispenser of claim 19 wherein the auger comprises a helical wire.

25. The article dispenser of claim 24 wherein the helical wire further comprises a central support extending along the longitudinal of the auger.

26. The article dispenser of claim 5 further comprising a retainer for at least some of said articles.

27. The article dispenser of claim 5 further comprising a deflector at or near an opening from the article bay and including a portion extending to catch and lift articles directly above lower-most articles.

28. The article dispenser of claim 27 wherein a portion of the deflector extends at an obtuse angle towards articles and terminates above lower-most articles.

29. The article dispenser of claim 6 further comprising a back wall angled inwardly at the articles.

30. The article dispenser of claim 6 wherein said top is angled downwardly at the rear of the article bay.

31. The article dispenser of claim 1 further comprising a monitor including a sensor to sense an article passing to an outlet from said article bay.

32. A dispenser assembly for holding a plurality of a product and dispensing said product one by one comprising:

(a) a housing having a bottom, back, and opposites sides;

(b) a generally unobstructed open space inside the housing adapted to hold said plurality of products;

(c) a conveying mechanism positioned at or near the bottom of the housing and positioned in the bottom of said space between the back and front of the housing.

33. A dispenser assembly for articles comprising:

(a) a helical member having a back and front ends along a longitudinal axis and comprising flights having article holding spaces therebetween, the helical member adapted to hold a row of articles to be dispensed transversely in said holding spaces and advance the articles to the front end of the helical member;

(b) a frame in which the helical member is positioned;

(c) a motor mounted to the frame and including a rotatable axle;

(d) a connection between the axle and the helical member adapted to cause rotation of the helical member around its longitudinal axis upon rotation of the axle of the motor;

(e) retaining walls positioned along the helical member on opposite sides of the longitudinal member, and extending upwardly to define a space adapted to hold, transversely of the longitudinal axis of the helical member, a plurality of articles to be dispensed in a stacked relationship of at least a lowermost layer and a succeeding layer above the lower-most layer;

(f) a retaining member positioned at or near the front of said space;

(g) an outlet from the frame at or near the front end of the helical member through which can pass an article in the front most position in the helical member.

34. The dispenser assembly of claim 33 further comprising a deflecting member near the front end of the helical member extending down from the frame to near the helical member adapted to allow an article in the helical member to pass, but deflect any article abutting and directly above the article in the helical member upon the front most article passing out of the helical member to the outlet.

35. The dispenser assembly of claim 33 wherein the articles are at least generally cylindrical.

36. The dispenser assembly of claim 33 wherein the articles are non-cylindrical.

37. The method of claim 36 wherein said articles are cylindrical containers.

38. A method of dispensing articles comprising:

(a) supporting a lower layer of articles;

(b) vertically stacking a one or more succeeding articles upon the lower layer;

(c) moving the lower layer towards an outlet;

(d) allowing an article in the lower layer closest the outlet to pass out of the outlet for dispension, reducing the number of articles in the lower layer by one, while the succeeding articles ride over one or more articles in the lower layer or, by gravity, assume a position in the lower layer.

39. The method of claim 38 wherein the cylindrical containers are beverage containers.

40. The method of claim 38 wherein the articles are products.

41. The method of claim 40 wherein the products are non-cylindrical.

42. The method of claim 38 wherein the articles are positioned in two rows.

43. The method of claim 38 wherein the articles are positioned in a plurality of rows vertically stacked.

44. The method of claim 38 wherein the step of supporting a lower layer of articles comprises supporting a lower layer of articles in a series from front to back.

45. The method of claim 44 wherein the lower layer is positioned along a longitudinal axis.

46. The method of claim 38 wherein the step of moving the lower layer comprises pushing the lower layer to an outlet.

47. The method of claim 38 wherein the step of moving the lower layer comprises pulling the lower layer.

48. The method of claim 38 wherein the step of retaining the succeeding articles comprises preventing movement of the succeeding articles to an outlet, but retaining succeeding articles in a defined space.

49. The method of claim 38 further comprising deflecting away from an outlet any succeeding article.

50. The method of claim 38 further comprising sensing movement of an article to or from an outlet.

51. The method of claim 38 further comprising repeating steps (c) and (d).

52. The method of claim 38 further comprising repeating steps (c) and (d) until at least a substantial number of articles are dispensed.

53. The method of claim 38 further comprising reloading articles into the vertical stack.

54. A method of dispensing articles comprising:

(a) supporting a plurality of cylindrical articles successively abutting and on top of one another from a row of articles in a bottom-most layer upwardly, the bottom-most layer having a front end and back end along a longitudinal axis;

(b) moving articles in the bottom-most layer along its longitudinal axis;

(c) dispensing an article from the bottom-most layer and creating a space in the bottom-most layer from the loss of said dispensed article.

55. The method of claim 54 further comprising allowing by gravity an article from above the bottom-most layer to fill the space in the bottom-most layer.

56. The method of claim 55 wherein the articles are generally cylindrical.

* * * * *